US008282431B1

(12) United States Patent
Zhang

(10) Patent No.: US 8,282,431 B1
(45) Date of Patent: Oct. 9, 2012

(54) FLOATING DOUBLE COMPRESSION CONNECTOR

(75) Inventor: George Huanyi Zhang, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/168,927

(22) Filed: Jun. 24, 2011

(51) Int. Cl.
*H01R 4/48* (2006.01)

(52) U.S. Cl. ..... 439/862; 439/91; 439/637; 439/591

(58) Field of Classification Search ..... 439/65, 439/66, 74, 91, 591, 636, 637, 862
See application file for complete search history.

(56) References Cited

U.S. PATENT DOCUMENTS 4,693,528 A 9/1987 Asick et al.
7,186,119 B2 * 3/2007 Perugini ..... 439/66
7,559,811 B1 * 7/2009 Polnyi ..... 439/862
7,775,805 B2 * 8/2010 Liao et al. ..... 439/66
7,878,818 B2 * 2/2011 Cheng et al. ..... 439/66
7,922,548 B2 * 4/2011 Fan ..... 439/862
7,950,933 B1 * 5/2011 Harlan ..... 439/91
2010/0184334 A1 * 7/2010 Ma ..... 439/626

* cited by examiner

*Primary Examiner* — James Harvey
(74) *Attorney, Agent, or Firm* — Wei Te Chung; Ming Chieh Chang

(57) ABSTRACT

An electrical connector includes a lengthwise housing and two rows of terminals. The housing defines two rows of passageways running through opposite first surface and second surface thereof to load with terminals. Each terminal includes a middle portion and two contacting arms extending from opposite ends of the middle portion. The two contacting arms of the terminals respectively extend beyond the first and second surfaces and curving inwards. Each terminal further includes a stopping rib and a spring rib at opposite lateral sides of the middle portion. Each passageway defines a first stopping shoulder adjacent to the second surface and a second stopping shoulder adjacent to the first surface. The stopping ribs are lodged against the first stopping shoulder or the spring ribs are lodged against the second stopping shoulder so that the terminals are moveable limited in the passageways.

13 Claims, 5 Drawing Sheets

FLOATING DOUBLE COMPRESSION CONNECTOR

BACKGROUND OF THE INVENTION

1. Field of the Invention

The present invention relates to an electrical connector, particularly to a floating double compressing connector to match with two circuit boards.

2. Description of Related Arts

Electrical connectors are widely and basically used in electronic assembly, device and system, for example, SATA (Serial Advanced Technology Attachment) connectors are used to connection between Hard Disk Drivers (HDD) and mother boards. SATA connector is also used in HDD storage. A new storage device named Solid State Disk or Solid State Driver is developed. Compared with conventional HDD storage, the SSD has advantage at higher performance, reduced power consumption, and reduced space requirements. Connectors adapted for said SSD device is desired. Related patent application Ser. No. 13/036,005 filed by the same assigner is pending in USPTO, which includes two rows of double compression conductive contacts. The contacts are interferencely retained in the insulating housing by bars at lateral sides thereof fitly.

SUMMARY OF THE INVENTION

An electrical connector adapted for connecting with two circuit boards includes comprises a lengthwise insulating housing and two rows of conductive terminals. The housing defines a first surface and a second surface opposite to the first surface confronting with said two circuit boards respectively and comprises two rows of passageways arranged along a lengthwise direction thereof and running through the first surface and the second surface. The terminals respectively are disposed in the two rows of passageways. Each terminal comprises a middle portion and two contacting arms extending from opposite ends of the middle portion for elastically pressing against said two circuit boards. The two contacting arms of said terminals respectively extend beyond the first and second surfaces and curving inwards. Each terminal further comprises a stopping rib at a first lateral side of the middle portion and a spring rib at a second lateral side opposite to the first lateral side of the middle portion. Each passageway defines a first stopping shoulder adjacent to the second surface and a second stopping shoulder adjacent to the first surface. The stopping ribs are lodged against the first stopping shoulder or the spring ribs are lodged against the second stopping shoulder so that the terminals are moveable limited in the passageways in a condition that a distance between the first stopping shoulder and the second stopping shoulder is larger than that between the stopping rib and the spring rib along a height direction perpendicular to the first and second surface.

Other advantages and novel features of the invention will become more apparent from the following detailed description of the present embodiment when taken in conjunction with the accompanying drawings

DETAILED DESCRIPTION OF THE PREFERRED EMBODIMENT

Further detailed description of the preferred embodiments of this present invention is set forth below along with the attached drawings.

Figure 1:
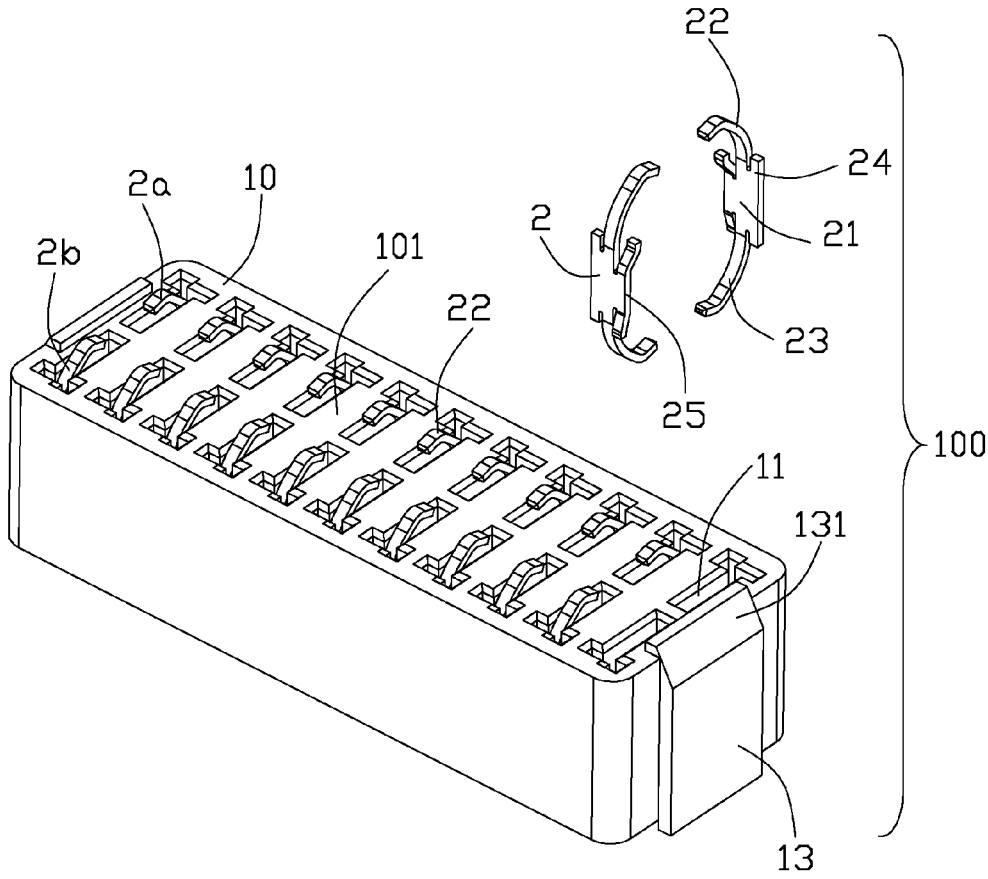
FIG. 1 is a top partially perspective exploded view of a compression connector in accordance with the present invention.
Figure 2:
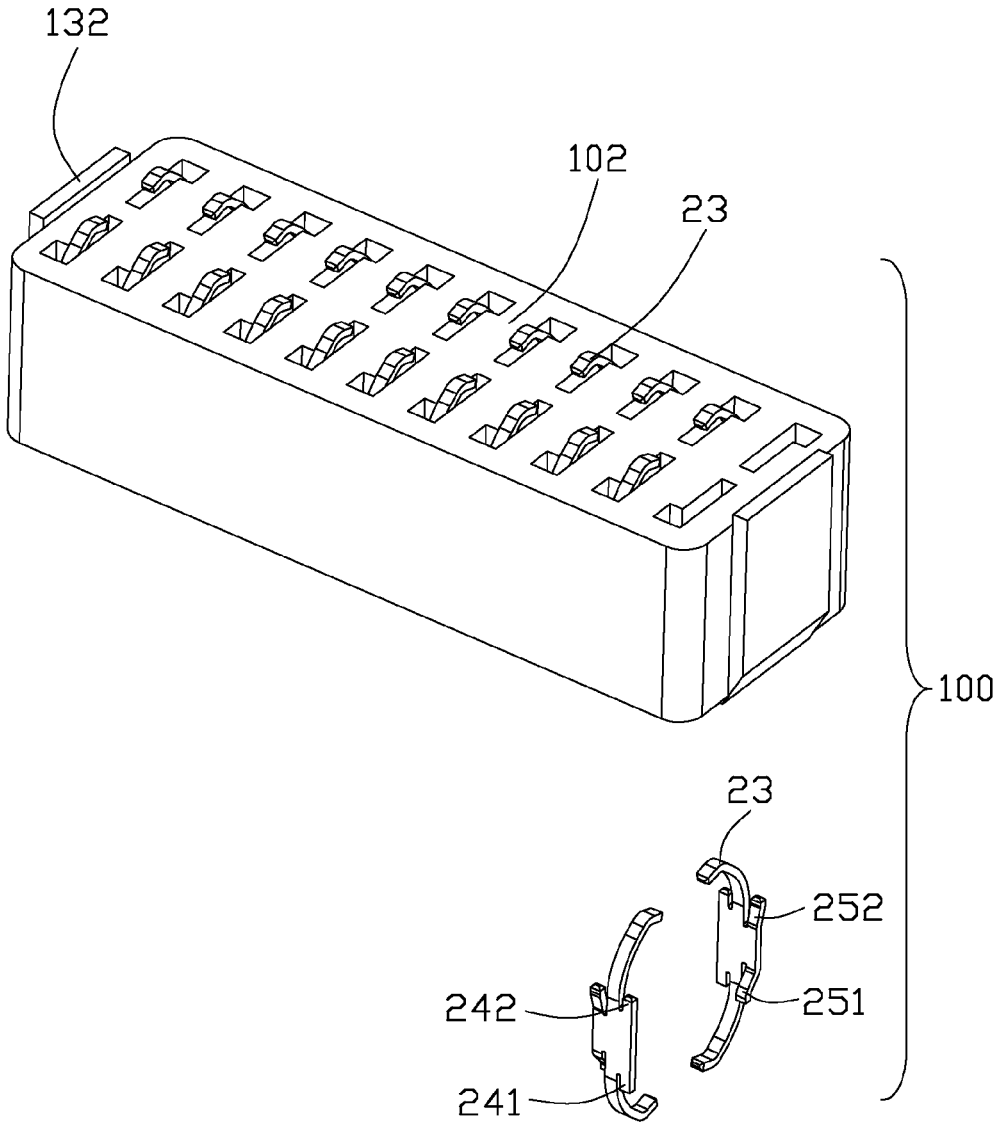
FIG. 2 is a bottom partially perspective exploded view of the compression connector.
Figure 5:
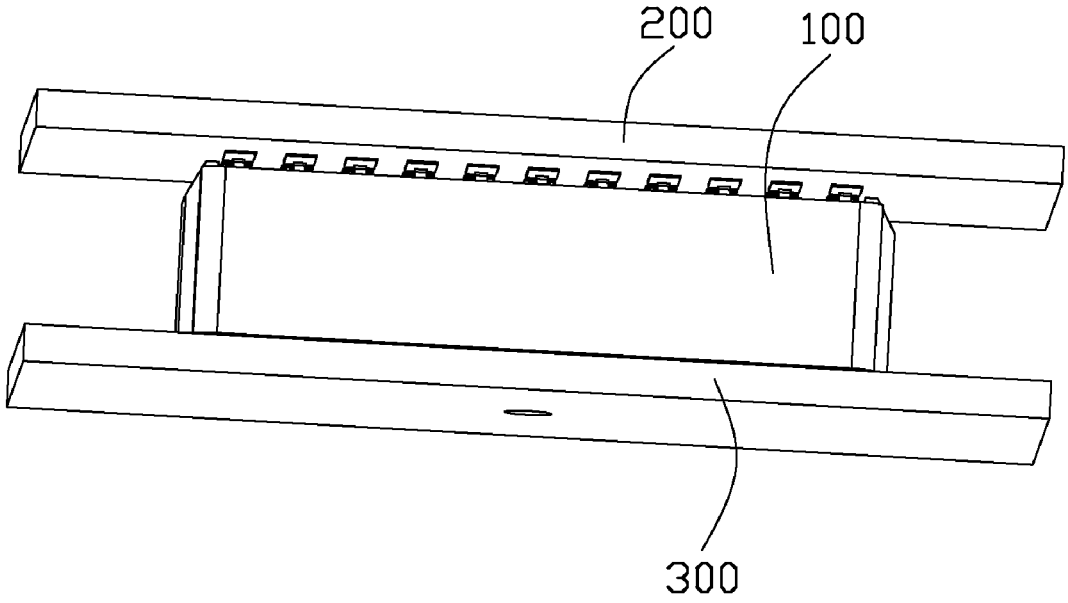
FIG. 5 is a perspective view of the compression connector connecting with two circuit boards.

Referring to FIGS. 1 through 2 in combination with FIG. 5, the electrical connector 100 is a double compression connector adapted for connecting with two circuit boards 200, 300. The connector 100 includes a lengthwise insulating housing 10 defining a first surface 101 and a second surface 102 opposite to the first surface confronting with said two circuit boards. The insulating housing defines two rows of passageways 11 at opposite side of a central axial thereof. Two groups of conductive terminals 2*a*, 2*b* are respectively received in the passageway 11 with spring contacting arms 22, 23 thereof extending beyond the first and second surface 101, 102 to be touched by said two circuit boards. Two ends along the lengthwise direction of the housing each define a projection 13 extending in a height direction from the second surface towards the first surface, with one slantwise guiding free end 131 projecting beyond the first surface and one planar free end 132 projecting beyond the second surface 102. The circuit boards are seat on the projections to ensure elasticity of the contacting arms.

The terminals of two rows located at opposite sides of the central axial respectively are in mirror relations. Each contact 2 includes a middle portion 21 and two contacting arms 22, 23 extending from upper and lower edges of the middle portion 21. The contacting arms 22, 23 curve inwards with an arc shape, i.e., the contacting arms extend toward the central axial. The terminal further includes a guiding rib 24 at one lateral side of the middle portion 21 and a spring rib 25 at another opposite lateral side of the middle portion. The guiding rib 24 extend with a same planar parallel to the middle portion 21 with two free ends 241, 242 beyond and slitting from the top and bottom edges of the middle portion 21. The spring rib 25 includes two spring arms 251, 252 extending at two ends thereof slantwise in opposite direction to offset the planar of the middle portion. The first spring arm 251 outwardly slants in an opposite direction to the contacting arms and a second spring arm 252 slant in a same direction with the contacting arms.

Figure 3:
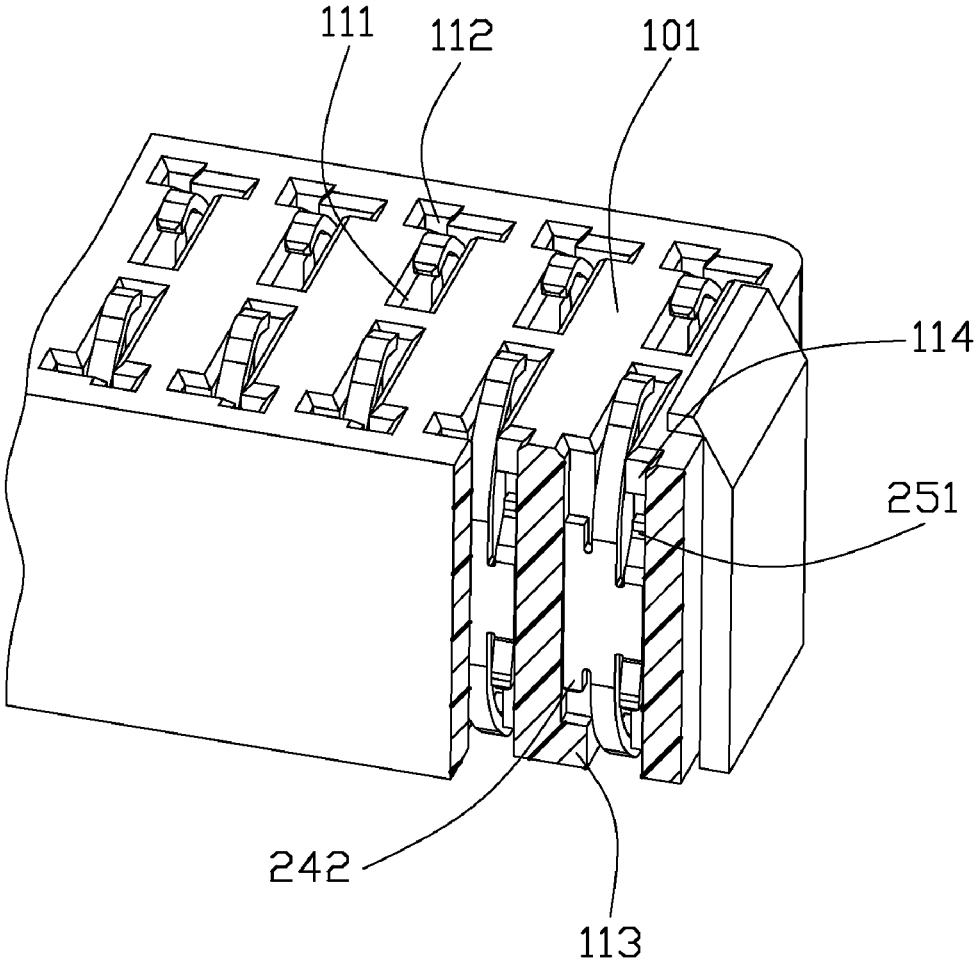
FIG. 3 is a partly cutout perspective view of the compression connector, showing the relationship of the terminals and the insulating housing.

Referring to FIG. 3 in combination with FIG. 2 showing a relationship of the terminals 2 and the passageways 11. The passageways of the two rows are in mirror pattern. Each passageway includes two portions, a first portion 111 and a second portion 112. The first portions of two rows of passageways extend perpendicularly to the lengthwise direction and the second portions 112 of two rows of passageways extend orthogonally to the first portions, so the second portions 112 are symmetrical about the first portions. In dimension, the first portions 111 are larger than the second portions 112 of the passageways. The second portion 112 of the passageway defines a first stopping shoulder 113 adjacent to the second surface 102 at a first side of the first portion 111 and a second stopping shoulder 114 adjacent to the first surface 101 at a second side opposite to the first side of the first portion.

Figure 4:
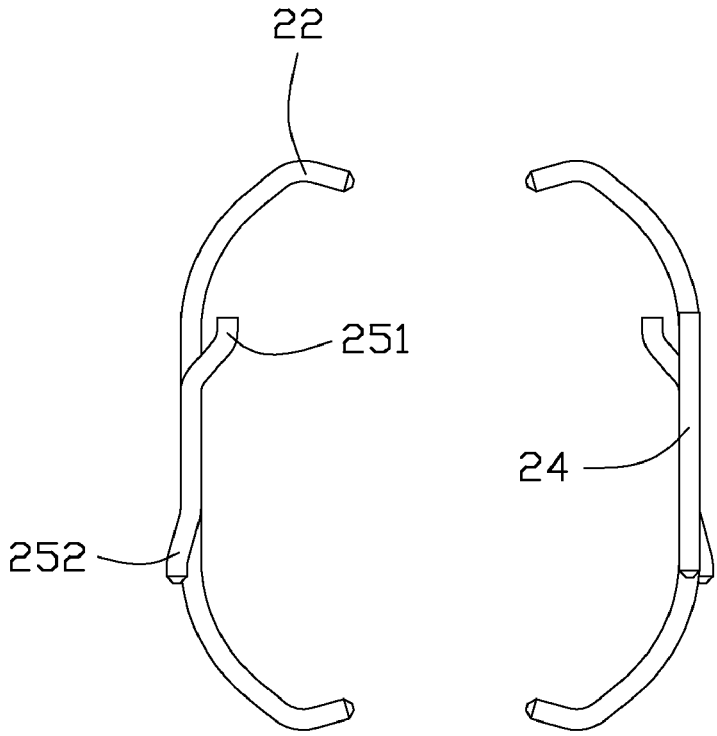
FIG. 4 is a front planar view of the terminal.

The terminals 2 are inserted in the passageways 11 from the first surface 101. During insertion, the second contacting arms 23 are aligned with the first portion 111 of the passageways and the guiding ribs 24 and the spring ribs 25 are aligned with the second portions 112 of the passageways wherein the lower free ends 242 are inserted in the first side of the second portions 112 of the passageways and the second spring arms 252 are inserted in the second side of the second portion 112 of the passageway to downwardly slide the terminals until the first spring arms 251 pass across the second stopping shoulder 114 located adjacent to the first surface. The first spring arms 251 bend with a larger angle than the second spring arms 252 as best shown in FIG. 4, so the spring rib can be assembled in the one piece insulating housing. Since a distance or a first vertical height between the first stopping shoulder 113 and the second stopper shoulder 114 are larger than that or a second vertical height between a top edge of the first spring arm 251 and a lower edge of the spring rib 24. So the terminals 2 can move in the second portions 111 of the passageways along the height direction. The terminals are limited in the passageway by the first stopping shoulder 113 and the second stopping shoulder 114 in a condition that the guiding ribs 24 are lodged against the first stopping shoulder 113 when the terminals move downwards and the spring ribs are lodged against the second stopping shoulder 114 when the terminals move upwards. The gap of the first vertical height and the second vertical height controls the moveable distance of the spring portions. The passageway might define a third stopping shoulder (not shown) adjacent to the second surface at opposite side of the second stopping shoulder against which the second spring arm is lodged.

Therefore, when the connector is connected with said two circuit boards, the contacting arms deform inward to provide force to contact with the circuit board. The terminal is elastically retained in the passageways, avoiding hard interference with the housing which can adjust engagement of connector and the circuit boards.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector adapted for connecting with two circuit boards, comprising:

a lengthwise insulating housing defining a first surface and a second surface opposite to the first surface confronting with said two circuit boards respectively, the insulating housing comprising two rows of passageways arranged along a lengthwise direction thereof and running through the first surface and the second surface; and two rows of conductive terminals respectively disposed in the two rows of passageways, each terminal comprising a middle portion and two contacting arms extending from opposite ends of the middle portion for elastically pressing against said two circuit boards, the two contacting arms of said terminals respectively extending beyond the first and second surfaces and curving inwards;

each terminals further comprising a stopping rib at a first lateral side of the middle portion and a spring rib at a second lateral side opposite to the first lateral side of the middle portion, each passageway defines a first stopping shoulder adjacent to the second surface and a second stopping shoulder adjacent to the first surface;

wherein the stopping ribs are lodged against the first stopping shoulder or the spring ribs are lodged against the second stopping shoulder so that the terminals are moveable limited in the passageways in a condition that a distance between the first stopping shoulder and the second stopping shoulder is larger than that between the stopping rib and the spring rib along a height direction perpendicular to the first and second surface.

2. The electrical connector as described in claim 1, wherein the stopping rib is in a same planar of the middle portion and each spring rib defines a first spring arm and a second spring arm at opposite ends thereof extending slantwise in opposite directions to offset the planar of the middle portion, the first spring arm are lodged against the second stopping shoulder.

3. The electrical connector as described in claim 2, wherein each passageway comprises a first portion and a second portion orthogonally to the first portion, the first stopping portion and the second stopping shoulder are located in the second portion and at opposite sides of the first portion of the passageway.

4. The electrical connector as described in claim 3, wherein the first spring arms bend with a larger angle than the second spring arms.

5. The electrical connector as described in claim 4, wherein the passageway defines a third stopping shoulder adjacent to the second surface at an opposite side of the second stopping shoulder against which the second spring arm is lodged.

6. The electrical connector as described in claim 5, wherein the terminals of said two rows are aligned with each other one by one in a transverse direction perpendicularly to the lengthwise direction and the height direction, the contacting arms are perpendicular to the planar of the middle portion.

7. An electrical connector adapted for connecting with two circuit boards, comprising:

a housing defining a first surface and a second surface opposite to the first surface confronting with said two circuit boards respectively, the housing comprising passageways running through the first surface and the second surface; and two parallel rows of terminals respectively disposed in the passageways, each terminal comprising a middle portion and two contacting arms extending from opposite ends of the middle portion for elastically pressing against said two circuit boards, the two contacting arms of said terminals respectively extending beyond the first and second surfaces and curving inwards;

the middle portions of the terminals being received in the passageways and shifting in the passageways along a second direction from the first surface to the second surface;

each terminals further comprising a stopping rib and a spring rib at opposite lateral sides of the middle portion, each passageway defines a first stopping shoulder adjacent to the second surface and a second stopping shoulder adjacent to the first surface;

wherein the stopping ribs are lodged against the first stopping shoulder when the terminals move towards the second surface and the spring ribs are lodged against the second stopping shoulder when the terminals move towards the first surface.

8. An electrical connector comprising:

an insulative housing defining a plurality of passageways extending therethrough along a vertical direction between opposite upper and bottom surfaces thereof;

a plurality of contacts disposed in the corresponding passageways, respectively, each of said contacts defining a main body spanning in a lengthwise direction of the housing with resilient contacting arms extending therefrom oppositely in said vertical direction and beyond the corresponding upper and bottom surfaces; and a pair of opposite spring arms extending oppositely in said vertical direction from one side of the main body of each of the contacts under condition that the pair of spring arms also extend in opposite lateral directions perpendicular to said vertical direction and said lengthwise direction.

9. The electrical connector as claimed in claim 8, wherein a guiding rib is formed on the other side of the main body opposite to the pair of spring arms in the lengthwise direction.

10. The electrical connector as claimed in claim 9, wherein said guiding rib extends coplanar with the main body.

11. The electrical connector as claimed in claim 8, wherein the housing defines a pair of corresponding stepped structures in each of the passageways in the vertical direction, against which the corresponding spring arms abut, respectively.

12. The electrical connector as claimed in claim 11, wherein each of said passageways defines an L-shaped opening in the one of the upper and bottom surfaces, and a T-shaped opening in the other of the upper and bottom surface.

13. The electrical connector as claimed in claim 11, wherein each of the contacts is floatable between the corresponding pair of stepped shoulder.

* * * * *